US007080414B1

(12) United States Patent
Montero et al.

(10) Patent No.: US 7,080,414 B1
(45) Date of Patent: Jul. 25, 2006

(54) MOTORCYCLE HELMET WINDSHIELD CONTROL SYSTEM AND METHOD

(76) Inventors: Fabián Montero, C/ Lirio, 23-Cobefia, 28863 Madrid (ES); Thomas B. Haverstock, 2350 Byron St., Palo Alto, CA (US) 94301

( * ) Notice: Subject to any disclaimer, the term of this patent is extended or adjusted under 35 U.S.C. 154(b) by 11 days.

(21) Appl. No.: 10/754,359

(22) Filed: Jan. 8, 2004

Related U.S. Application Data

(63) Continuation-in-part of application No. 10/723,532, filed on Nov. 26, 2003.

(51) Int. Cl.
*A42B 1/08* (2006.01)

(52) U.S. Cl. ..... 2/424; 2/906; 340/432

(58) Field of Classification Search ..... 2/410, 2/424, 906, 6.3, 6.4, 6.5, 425; 340/432
See application file for complete search history.

(56) References Cited

U.S. PATENT DOCUMENTS 4,546,498 A * 10/1985 Fantin ..... 2/424
5,072,209 A * 12/1991 Hori et al. ..... 340/432
5,297,297 A * 3/1994 Pei ..... 2/424
5,315,289 A * 5/1994 Fuller et al. ..... 340/532
5,704,707 A * 1/1998 Gebelein et al. ..... 362/106
6,370,700 B1 4/2002 Arion ..... 2/424
6,720,870 B1 * 4/2004 Morse ..... 340/468
6,861,970 B1 * 3/2005 Garland ..... 342/20
6,877,169 B1 * 4/2005 Acquaviva ..... 2/429

FOREIGN PATENT DOCUMENTS

CA 2124780 12/1995
CA 2124780 A1 * 12/1995
FR 2 610 484 8/1988
FR 2610484 A1 * 8/1988
FR 2834865 A1 * 7/2003

* cited by examiner

*Primary Examiner*—Rodney Lindsey
(74) *Attorney, Agent, or Firm*—Haverstock & Owens LLP

(57) ABSTRACT

A motorcycle windshield control system is disclosed. The system includes a receiver and filter circuit coupled to a motorcycle helmet having a windshield for receiving and filtering electromagnetic signals generated by an electrical device of a motorcycle. Alternatively, the receiver and filter circuit can receive signals emitted by an emitter installed on the motorcycle. The system also includes a control circuit coupled to the receiver and filter circuit, for performing a Boolean operation to activate a raiser motor for adjusting a position of the windshield when the Boolean operation generates a high logic level. The system can also include a manual override switch.

78 Claims, 4 Drawing Sheets

MOTORCYCLE HELMET WINDSHIELD CONTROL SYSTEM AND METHOD

Related Application

This patent application is a continuation-in-part of commonly owned co-pending U.S. patent application Ser. No. 10/723,532, filed Nov. 26, 2003, entitled "MOTORCYCLE HELMET WINDSHIELD CONTROL SYSTEM AND METHOD."

FIELD OF THE INVENTION

This invention relates generally to a mechanism and apparatus for controlling a helmet windshield. More specifically, this invention relates to a mechanism and apparatus for automatically adjusting a position of a helmet windshield such that the windshield automatically opens up during stopped periods and closes down when restarting motion occurs.

BACKGROUND OF THE INVENTION

A motorcycle helmet provides safety to a motorcycle driver. Most helmets are equipped with a windshield or face shield. A helmet's windshield protects the face of the driver against flying debris, rain, wind, and insects while driving a motorcycle.

During stopped periods, e.g. at traffic lights, a closed helmet can be uncomfortable for a driver, especially under certain weather conditions. Helmets can get extremely warm and foggy at stopped periods in hot weather. To obtain relief, the driver manually opens the windshield at stopped periods and then manually closes the windshield before driving off. This sequence may be repeated at each stopped period, which can inconvenience and/or delay the driver.

What is needed is a helmet whose windshield automatically open up during stopped periods and closes down when restarting motion occurs.

BRIEF SUMMARY OF THE INVENTION

In accordance with an embodiment of the present invention, an apparatus is disclosed. The apparatus comprises a helmet for use with a motorcycle; a windshield coupled to the helmet; and means for automatically adjusting a position of the windshield when sound generated by a motorcycle engine crosses a predetermined threshold value. The apparatus can include an acoustic sensor coupled to the helmet for sensing the generated sound. The apparatus can also include a manual override switch coupled to the helmet so that a user can manually adjust the windshield to a desired position.

The means for automatically adjusting can comprise a control circuit for receiving a plurality of signals to perform a Boolean operation. The control circuit comprises a three-input Boolean And gate. The position of the windshield is adjusted when the Boolean operation generates a high logic level. The position of the windshield can be adjusted by temporarily releasing a pawl from a rod and activating a raiser motor to reach a new windshield position. The rod preferably maintains the windshield at its current position.

The apparatus can further include a power supply coupled to the control circuit for supplying power to the raiser motor. The power supply can comprise one or more batteries. Alternatively, the power supply can comprise one or more solar cells.

In an alternative embodiment of the present invention, an apparatus is disclosed. The apparatus comprises a helmet for use with a motorcycle; a windshield coupled to the helmet; and means for automatically adjusting a position of the windshield when a gear shift lever of a vehicle is moved away from a neutral position to a position other than neutral, and vice versa. The apparatus can include detection circuit which detects a change of the gear shift lever and emits a digital signal to the means for automatically adjusting through an antenna and filter circuit. The digital signal can be emitted in the form of an ultrasonic signal. Alternatively, the digital signal can be emitted in the form of an optical signal. The detection circuit can be a sensor.

In another embodiment of the present invention, an apparatus is disclosed. The apparatus comprises a helmet for use with a motorcycle; a windshield coupled to the helmet; and means for automatically adjusting a position of the windshield when a gear shift lever of a vehicle is shifted from a second gear position to a third gear position, and vice versa.

In an another embodiment of the present invention, a mechanism for a helmet windshield of a motorcycle is disclosed. The mechanism comprises means for automatically adjusting a position of the windshield when sound generated by a motorcycle engine crosses a predetermined threshold value.

In an another embodiment of the present invention, a mechanism for a helmet windshield of a motorcycle is disclosed. The mechanism comprises means for automatically adjusting a position of the windshield when a gear shift lever of the motorcycle is moved away from a neutral position to a position other than neutral, and vice versa.

In an another embodiment of the present invention, a mechanism for a helmet windshield of a motorcycle is disclosed. The mechanism comprises means for automatically adjusting a position of the windshield when a gear shift lever of the motorcycle is shifted from a second gear position to a third gear position, and vice versa.

In another embodiment of the present invention, a motorcycle windshield control system is disclosed. The system includes an acoustic sensor coupled to a motorcycle helmet having a windshield for sensing sound generated by a motorcycle engine. The system further includes a control circuit coupled to the acoustic sensor for performing a Boolean operation, such that a position of the windshield is adjusted in response to the Boolean operation.

In another embodiment of the present invention, a method is disclosed. The method comprises the steps of providing a helmet for use with a motorcycle; providing a windshield coupled to the helmet; and providing means for automatically adjusting a position of the windshield when a gear shift lever of a vehicle is moved away from a neutral position to a position other than neutral, and vice versa.

In another embodiment of the present invention, a method is disclosed. The method comprises the steps of providing a helmet for use with a motorcycle; providing a windshield coupled to the helmet; and providing means for automatically adjusting a position of the windshield when a gear shift lever of a vehicle is shifted from a second gear position to a third gear position, and vice versa.

In another embodiment of the present invention, a method of automatically adjusting a position of a helmet windshield for use with a motorcycle is disclosed. The method comprises the steps of sensing sound generated by the motorcycle's engine; and performing a Boolean operation to activate a raiser motor for adjusting the position of the helmet windshield in response to the Boolean operation.

In another embodiment of the present invention, an apparatus is disclosed. The apparatus comprises a helmet; a windshield coupled to the helmet; and means for automatically adjusting a position of the windshield when precipitation detected by a sensor coupled to the windshield crosses a predetermined threshold value. The precipitation can be at least one of rain, sleet, hail and snow. The sensor can be a precipitation sensor.

In another embodiment of the present invention, an apparatus is disclosed. The apparatus comprises a helmet; a windshield coupled to the helmet; and means for automatically adjusting a position of the windshield when high velocity winds detected by a sensor coupled to the windshield exceed a predetermined threshold value. The sensor can be a high velocity sensor. The high velocity winds can be sand storms. The high velocity winds can also be gravel storms.

In another embodiment of the present invention, a mechanism for a helmet windshield of a motorcycle is disclosed. The mechanism comprises means for automatically adjusting a position of the windshield when precipitation detected by a sensor coupled to the windshield crosses a predetermined threshold value.

In another embodiment of the present invention, a mechanism for a helmet windshield of a motorcycle is disclosed. The mechanism comprises means for automatically adjusting a position of the windshield when high velocity winds detected by a sensor coupled to the windshield exceed a predetermined threshold value.

In another embodiment of the present invention, a method is disclosed. The method comprises the steps of providing a helmet for use with a motorcycle; providing a windshield coupled to the helmet; and providing means for automatically adjusting a position of the windshield when precipitation detected by a sensor coupled to the windshield crosses a predetermined threshold value.

In another embodiment of the present invention, a method is disclosed. The method comprises the steps of providing a helmet for use with a motorcycle; providing a windshield coupled to the helmet; and providing means for automatically adjusting a position of the windshield when high velocity winds detected by a sensor coupled to the windshield exceed a predetermined threshold value.

In another embodiment of the present invention, an apparatus is disclosed. The apparatus comprises a helmet; a windshield coupled to the helmet; and means for automatically adjusting a position of the windshield when vehicle speed as indicated by an accelerometer coupled to the vehicle exceeds a predetermined threshold value. The accelerometer preferably generates an output signal based on the vehicle speed and electrically communicates with an antenna and filter circuit.

In another embodiment of the present invention, an apparatus is disclosed. The apparatus comprises a helmet; a windshield coupled to the helmet; and means for automatically adjusting a position of the windshield, wherein a heat sensor coupled to the helmet activates the windshield t open when ambient temperature exceeds a first predetermined threshold value. Further, the heat sensor activates the windshield to close when the ambient temperature drops below a second predetermined threshold value, after a specific time delay period. The specific time delay period is preferably a function of the ambient temperature.

In another embodiment of the present invention, a mechanism for a helmet windshield of a motorcycle is disclosed. The mechanism comprises means for automatically adjusting a position of the windshield when vehicle speed as indicated by an accelerometer coupled to the motorcycle exceeds a predetermined threshold value.

In another embodiment of the present invention, a mechanism for a helmet windshield of a motorcycle is disclosed. The mechanism comprises means for automatically adjusting a position of the windshield wherein a heat sensor coupled to a helmet activates the windshield to open when ambient temperature exceeds a first predetermined threshold value. Further, the heat sensor activates the windshield to close when the ambient temperature drops below a second predetermined threshold value, after a specific time delay period.

In another embodiment of the present invention, a method is disclosed. The method comprises the steps of providing a helmet for use with a motorcycle; providing a windshield coupled to the helmet; and providing means for automatically adjusting a position of the windshield when vehicle speed as indicated by an accelerometer coupled to the motorcycle exceeds a predetermined threshold value.

In another embodiment of the present invention, a method is disclosed. The method comprises the steps of providing a helmet for use with a motorcycle; providing a windshield coupled to the helmet; and providing means for automatically adjusting a position of the windshield, wherein a heat sensor coupled to the helmet activates the windshield to open when ambient temperature exceeds a first predetermined threshold value. Further, the heat sensor activates the windshield to close when the ambient temperature drops below a second predetermined threshold value, after a specific time delay period.

DETAILED DESCRIPTION OF THE INVENTION

Reference will now be made in detail to the preferred and alternative embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it should be noted that the present invention may be practiced without these specific details. In other instances, well known methods, procedures and components have not been described in detail as not to unnecessarily obscure aspects of the present invention.

Figure 1:
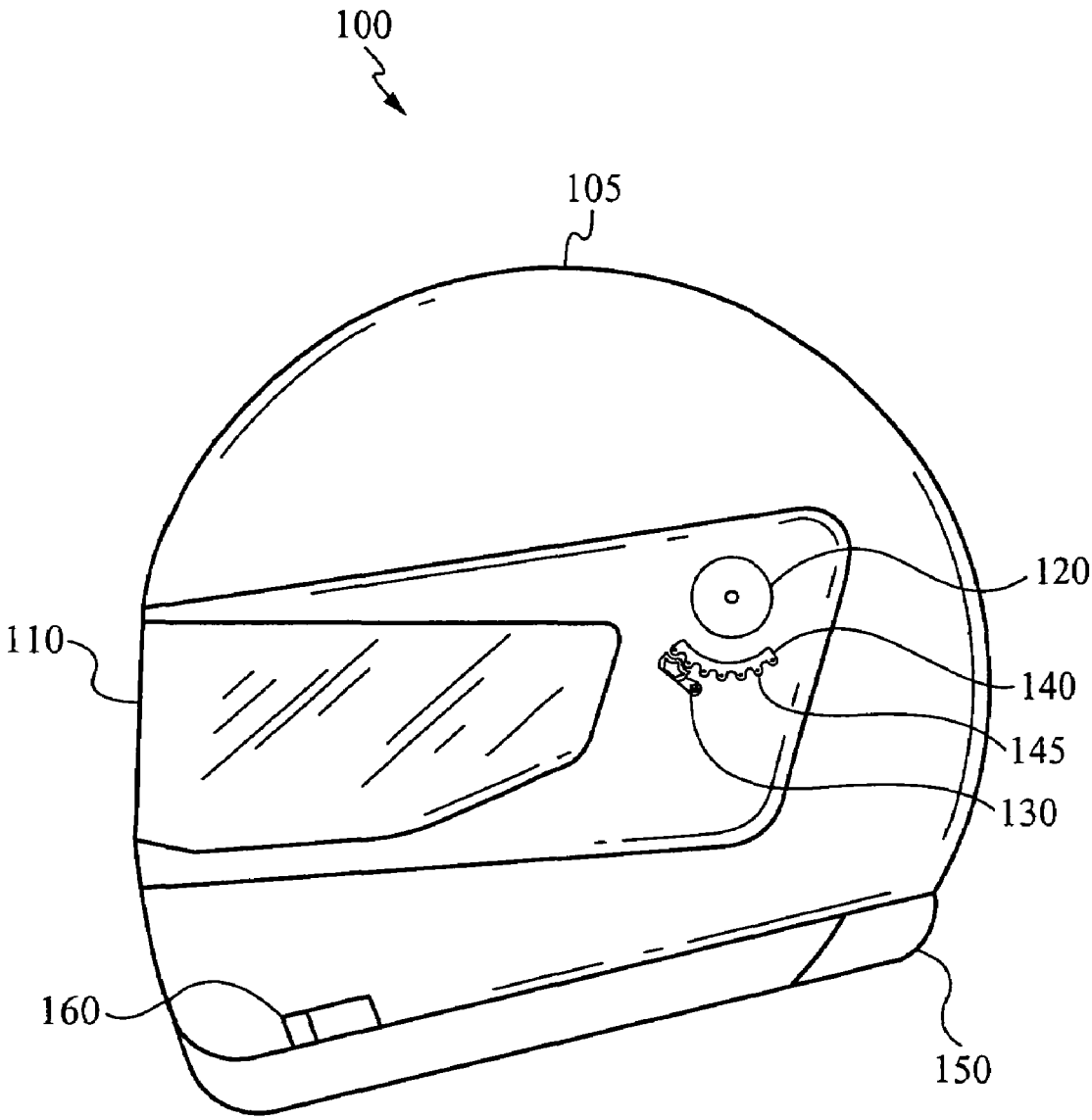
FIG. 1 illustrates a side view of an apparatus for controlling a motorcycle helmet windshield.

Referring now to the drawings and particularly to FIG. 1, there is shown one embodiment of an apparatus 100 for controlling a motorcycle helmet windshield. The apparatus 100 includes a helmet 105 for use with a motorcycle and a windshield or shield 110 coupled to the helmet 105. The helmet can be made of fiberglass, Kevlar, or a polycarbonate mixture. The helmet can also include an optional chin strap. The shield can be made of clear or tinted optical-quality polycarbonate or any shatter-proof material. The apparatus further includes means for automatically adjusting a position of the shield 110 when a speed of the motorcycle crosses a predetermined threshold. The apparatus can also include means for automatically adjusting a position of the shield 110 when sound generated by a motorcycle engine crosses a predetermined threshold value. Alternatively, the apparatus can include means for automatically adjusting a position of the shield 110 when a gear shift lever of the motorcycle is shifted from either a neutral position to a position other than neutral and vice versa, or a second gear position to a third gear position and vice versa.

The mean for automatically adjusting can be an automatic control system 120. The automatic control system 120, as will be explained in more detail below with the block diagram of FIG. 3, can sense electromagnetic signals from an electrical device of the motorcycle, such as a spark plug, or a device installed on the motorcycle, such as an emitter circuit, and automatically and appropriately position the shield 110 of the helmet 105, such that the shield 110 automatically opens during stopped periods and closes down during driving periods. The automatic control system 120 can also include an acoustic sensor (not shown) for sensing sound generated by a motorcycle engine. Further, the automatic control system 120 can receive ultrasonic signals and optical signals emitted by a lever detection circuit (not shown) on the motorcycle for detecting changes of the gear shift lever. The detection circuit can be a sensor.

The apparatus 100 also includes a pawl and pawl release mechanism 130 mounted to the shield 110 for movement between opened and closed positions relative to teeth 145 of a rigid rod 140 and a batteries compartment 150, for housing batteries, to supply power to the automatic control system 120. The batteries are preferably rechargeable. In an alternative embodiment, the helmet 105 can include solar power collectors which are preferably incorporated into an upper surface of the helmet 105 for charging the batteries. The apparatus 100 also includes a selector switch 160, which can be a manual override switch, coupled to the helmet 105 so that a user can manually adjust the windshield 110 to a desired position or disable the invention such as during cold or inclement weather.

Figure 2:
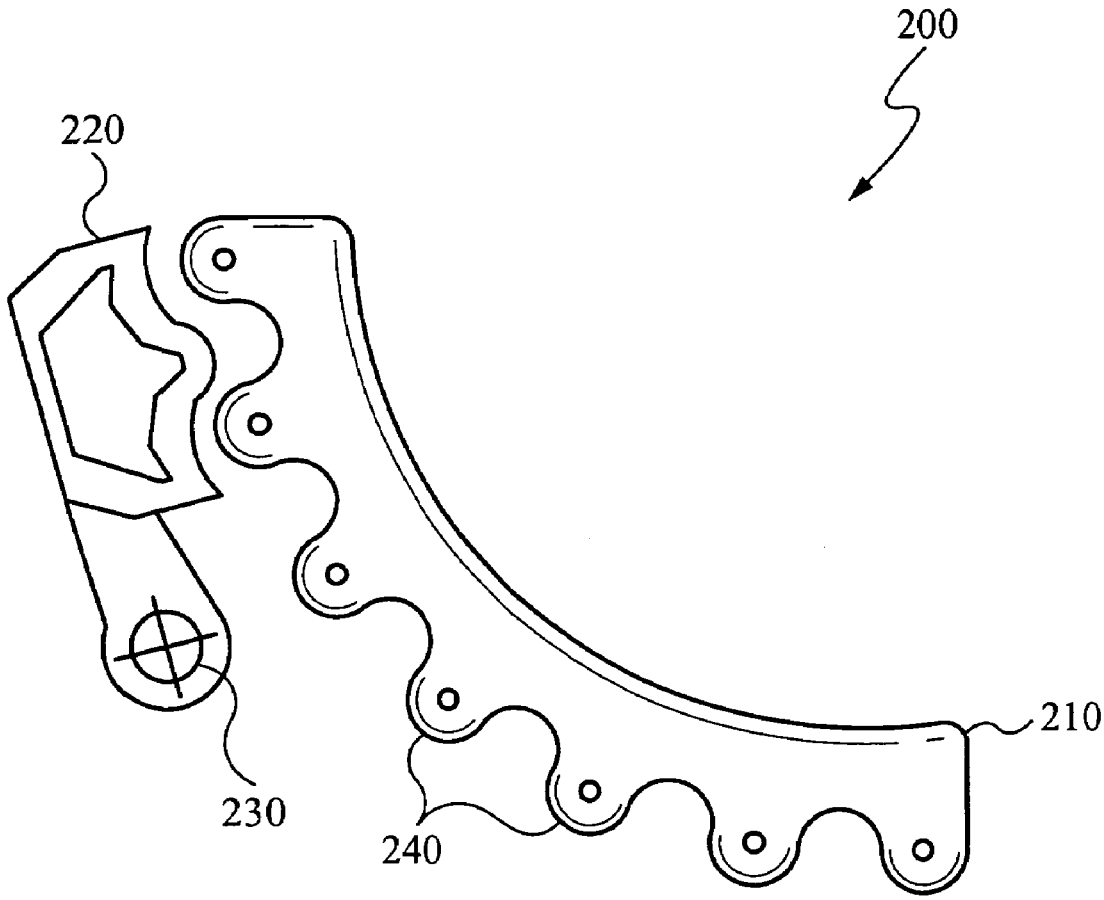
FIG. 2 illustrates a schematic diagram of a pawl and rod arrangement in accordance with the present invention.

FIG. 2 is a schematic diagram of a pawl and rod arrangement 200 in accordance with the present invention. A pawl 220 is mounted on the helmet 105 (FIG. 1) and engageably coupled to a rod 210 having a plurality of teeth 240 for movement relative to the rod 210. A pawl release 230 is attached to the pawl. The pawl release 230 provides a mechanism for disengaging the pawl from the teeth, thereby allowing unrestricted movement between opened and closed positions of the shield. When the pawl release 230 receives a signal to change a position of the shield, the pawl release releases the pawl from the rod and allows the pawl to move to a new position on the rod 210 as the shield 110 (FIG. 1) moves.

Figure 3:
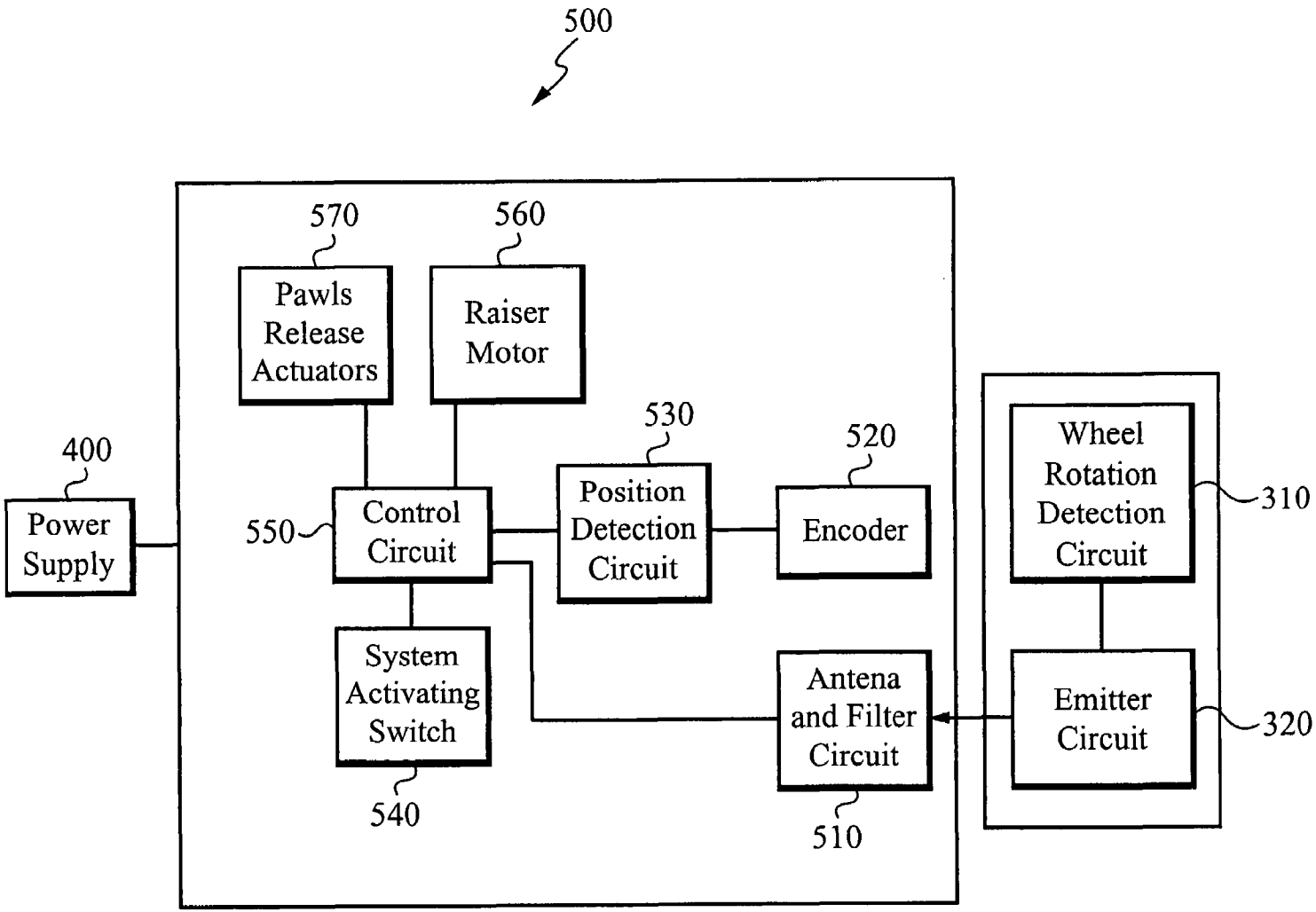
FIG. 3 illustrates a block diagram of an automatic control system for adjusting a position of a helmet windshield for use with a motorcycle.

FIG. 3 is a block diagram of an automatic control system 500 for adjusting a position of a helmet windshield for use with a motorcycle. The control system 500 is coupled to a power supply 400 for supplying power to a raiser motor 560 of the control system 500. The control system also includes a pawl release actuator 570 which is electrically coupled to the pawl and rod arrangement of FIG. 2, a system activating switch 540 to provide manual override of the system 500, a position detection circuit 530 which corresponds to a current position of the windshield, and an antenna and filter circuit 510 for receiving and filtering electromagnetic signals generated from a device(s) or circuit(s) of the motorcycle. The position detection circuit 530 can be coupled to an encoder 520 for detecting the position of the windshield. The system activating switch 540, the position detection circuit 530 and the antenna and filter circuit 510 can all send signals to a control circuit 550, which will be discussed more fully below.

The antenna and filter circuit 510 can receive electromagnetic signals generated by an emitter circuit 320 of a motorcycle and rejects emissions other than from the emitter circuit 320 of the motorcycle. Alternatively, the antenna and filter circuit 510 can receive electromagnetic signals from an electrical device (not shown) of the motorcycle. The electrical device (not shown) can be a spark plug. Alternatively, the antenna and filter circuit 510 can receive ultrasonic signals and optical signals from a lever detection circuit (not shown) coupled to detect changes of the gear shift lever. Further, the antenna and filter circuit 510 can receive output signals indicative of motorcycle speed, wherein the output signals are generated by an accelerometer (not shown) coupled to the motorcycle. The control system 500 preferably adjusts the windshield 110 (FIG. 1) if the output signals from the accelerometer (not shown) exceed a predetermined threshold value. The lever detection circuit (not shown) can comprise a sensor. The antenna and filter circuit 510 can be replaced by an acoustic sensor (not shown) for sensing sound generated by a motorcycle engine. The antenna and filter circuit 510 can also be replaced by a heat sensor (not shown) for activating the windshield 100 (FIG. 1) to open when ambient temperature exceeds a predetermined threshold value. Further, the heat sensor (not shown) can activate the windshield 110 (FIG. 1) to close when the ambient temperature drops below a second predetermined threshold value, after a specific time delay period. The specific time delay period is preferably a function of the ambient temperature.

The emitter circuit 320 is coupled to a wheel rotation detection circuit 310 for detecting the speed of the motorcycle. The detection circuit 310 sends a digital signal to the emitter circuit 320 when the speed of the motorcycle crosses a predetermined threshold value. The predetermined threshold value can be in units of revolutions per minute (RPM). The detection circuit 310 can be a sensor. Once the electromagnetic signals are received and filtered by the antenna and filter circuit 510, an electrical signal (or signals) is sent to the control circuit 550 for receiving a plurality of signals to perform a Boolean operation.

The control circuit 550 comprises a three-input Boolean And gate. The control circuit 550 receives the plurality of signals from the antenna and filter circuit 510, the position detection circuit 530 and the system activating switch 540, to perform the Boolean operation. The position of the windshield is adjusted when the Boolean operation generates a high logic level. In other words, each signal or signals sent by the circuits 510 and 530 and the switch 540 must be in a high logic level, for example 5 V rather than 0 V, before the control circuit 550 can activate the actuator 570 and the motor 560 to adjust the position of the windshield. When the control circuit 550 generates a high logic level, a change of position of the shield is automatically activated by temporarily releasing the pawl 220 (FIG. 2) from the rod 210 (FIG. 2) via a pawl release actuator 570, which maintains the shield at its last position, and activating the motor 560 to cause the pawl release 230 (FIG. 2) to move the pawl 220 (FIG. 2) to a new position on the rod 210.

The circuit can include a timer when the circuit 320 is configured to trigger off electromagnetic signals such as spark plug noise. When a motorcycle rider is stopped and the engine is idling, the shield 110 (FIG. 1) will rise. If the rider briefly revs the engine it is desired that the shield 110 (FIG. 1) remain up. The timer would only lower the shield 110 (FIG. 1) after a sustained increase in engine speed, such as more than two seconds. It will be appreciated that the preferred Boolean operation is representative only and that any other Boolean function can be used.

Figure 4:
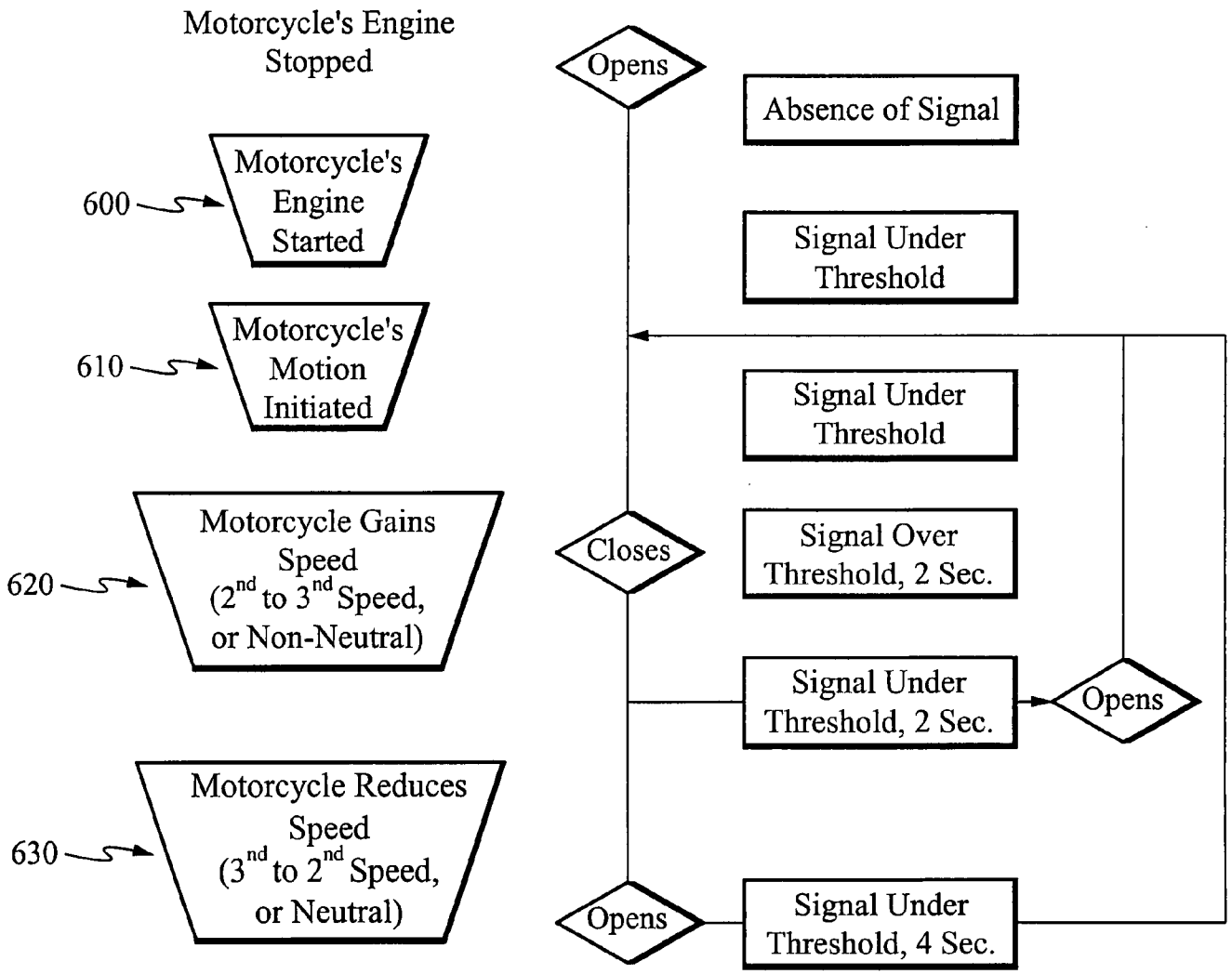
FIG. 4 illustrates a flow chart of a method of automatically adjusting a position of a windshield in accordance with the present invention.

FIG. 4 is a flow chart of a method of automatically adjusting a position of a windshield when a gear shift lever of a vehicle is shifted from either neutral position to a position other than neutral, and vice versa or from a second gear position to a third gear position, and vice versa. A lever detection circuit (not shown) is preferably coupled to the motorcycle for detecting changes of the gear shift lever. The lever detection circuit (not shown) can be a sensor. In the initial position, the engine is turned off. At 600, the ignition is turned on and the engine is started with the motorcycle. At 610, the motorcycle is in motion with the windshield open. At 620, as the motorcycle gains speed and the gear shift lever is shifted from neutral to first gear, the lever detection circuit will detect this change and emit a digital signal to the control system 500 (FIG. 3) to close the windshield. Alternatively, the lever detection circuit (not shown) can be designed to emit a digital signal to close the windshield when the gear shift lever is shifted from second gear to third gear, and vice versa. At 630, when the motorcycle reduces speed and the gear shift lever is shifted into neutral or, alternatively, from third gear to second gear, the windshield will open.

Variations of the above-described embodiments are contemplated and readily appreciable to one skilled in the art. For example, the control circuit 550 can include a memory chip for storing data including speed versus time information of the motorcycle, histogram information, average speed information, and the number of stopped periods. The memory chip can apply a data compression algorithm for compressing the stored data to conserve memory resources. In other embodiments, the control system 500 can include an interface circuit with specific software to interface with a personal computer for downloading and analyzing the data via a connector and setting up the threshold values at which the detection circuit 310 sends a digital signal to the emitter circuit 320. The connector can be a Universal Serial Bus (USB) port. The connector can also be a wireless transceiver or a PC Card interface.

In yet another embodiment of the present invention, the antenna and filter circuit 510 (FIG. 3) can be replaced by an precipitation sensor (not shown) for detecting precipitation and automatically adjusting a position of the shield 110 (FIG. 1) when the precipitation crosses a predetermined threshold value. The precipitation can be at least one of rain, sleet, hail, and snow. For example, if a certain amount of precipitation is detected, and the shield 110 (FIG. 1) is in the open position, then the shield 110 (FIG. 1) would be automatically moved to the closed position.

In yet another embodiment of the present invention, the antenna and filter circuit 510 (FIG. 3) can be replaced by a high velocity wind sensor (not shown) for detecting high velocity winds and automatically adjusting a position of the shield 110 (FIG. 1) when the high velocity winds cross a predetermined threshold value. The high velocity winds can be sand storms. Alternatively, the high velocity winds can be gravel storms.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made to the embodiments chosen for illustration without departing from the spirit and scope of the invention.

What is claimed is:

1. An apparatus, comprising:

a. a helmet;

b. a windshield coupled to the helmet; and c. means for automatically adjusting a position of the windshield when sound generated by a motorcycle engine crosses a predetermined threshold value.

2. The apparatus of claim 1 further including an acoustic sensor coupled to the helmet for sensing the generated sound.

3. The apparatus of claim 1 wherein the means for automatically adjusting comprises a control circuit for performing a Boolean operation.

4. The apparatus of claim 3 further including a power supply coupled to the control circuit for supplying power to the means for automatically adjusting.

5. The apparatus of claim 1 further including a manual override switch coupled to the helmet so that a user can manually adjust the windshield to a desired position.

6. An apparatus, comprising:

a. a helmet;

b. a windshield coupled to the helmet; and c. means for automatically adjusting a position of the windshield when a gear shift lever of a vehicle is moved away from a neutral position to a position other than neutral, and vice versa.

7. The apparatus of claim 6 wherein a detection circuit detects a change of the gear shift lever and emits a digital signal to the means for automatically adjusting through an antenna and filter circuit.

8. The apparatus of claim 7 wherein the digital signal is emitted in the form of an ultrasonic signal.

9. The apparatus of claim 7 wherein the digital signal is emitted in the form of an optical signal.

10. The apparatus of claim 7 wherein the detection circuit comprises a sensor.

11. The apparatus of claim 6 wherein the means for automatically adjusting comprises a control circuit for performing a Boolean operation.

12. The apparatus of claim 11 further including a power supply coupled to the control circuit for supplying power to the means for automatically adjusting.

13. The apparatus of claim 6 further including a manual override switch coupled to the helmet so that a user can manually adjust the windshield to a desired position.

14. An apparatus, comprising:

a. a helmet;

b. a windshield coupled to the helmet; and c. means for automatically adjusting a position of the windshield when a gear shift lever of a vehicle is shifted from a second gear position to a third gear position, and vice versa.

15. The apparatus of claim 14 wherein a detection circuit detects a change of the gear shift lever and emits a digital signal to the means for automatically adjusting through an antenna and filter circuit.

16. The apparatus of claim 15 wherein the digital signal is emitted in the form of an ultrasonic signal.

17. The apparatus of claim 15 wherein the digital signal is emitted in the form of an optical signal.

18. The apparatus of claim 15 wherein the detection circuit comprises a sensor.

19. The apparatus of claim 14 wherein the means for automatically adjusting comprises a control circuit for performing a Boolean operation.

20. The apparatus of claim 19 further including a power supply coupled to the control circuit for supplying power to the means for automatically adjusting.

21. The apparatus of claim 14 further including a manual override switch coupled to the helmet so that a user can manually adjust the windshield to a desired position.

22. A mechanism for a helmet windshield of a motorcycle, comprising means for automatically adjusting a position of the windshield when sound generated by a motorcycle engine crosses a predetermined threshold value.

23. A mechanism for a helmet windshield of a motorcycle, comprising means for automatically adjusting a position of the windshield when a gear shift lever of the motorcycle is moved away from a neutral position to a position other than neutral, and vice versa.

24. The mechanism of claim 23 wherein a detection circuit detects a change of the gear shift lever and emits a digital signal to the means for automatically adjusting through an antenna and filter circuit.

25. The mechanism of claim 24 wherein the digital signal is emitted in the form of an ultrasonic signal.

26. The mechanism of claim 24 wherein the digital signal is emitted in the form of an optical signal.

27. The mechanism of claim 24 wherein the detection circuit comprises a sensor.

28. A mechanism for a helmet windshield of a motorcycle, comprising means for automatically adjusting a position of the windshield when a gear shift lever of the motorcycle is shifted from a second gear position to a third gear position, and vice versa.

29. The mechanism of claim 28, wherein a detection circuit detects a change of the gear shift lever and emits a digital signal to the means for automatically adjusting through an antenna and filter circuit.

30. The mechanism of claim 29 wherein the digital signal is emitted in the form of an ultrasonic signal.

31. The mechanism of claim 29 wherein the digital signal is emitted in the form of an optical signal.

32. The mechanism of claim 29 wherein the detection circuit comprises a sensor.

33. A motorcycle helmet windshield control system, comprising:

a. an acoustic sensor coupled to a motorcycle helmet having a windshield for sensing sound generated by a motorcycle engine; and b. a control circuit coupled to the acoustic sensor for performing a Boolean operation, such that a position of the windshield is adjusted in response to the Boolean operation.

34. The system of claim 33 further including a manual override switch coupled to the helmet so that a user can manually adjust the windshield to a desired position, wherein the manual override switch sends an override signal to the control circuit.

35. A method, comprising the steps of:

a. providing a helmet for use with a motorcycle;

b. providing a windshield coupled to the helmet; and c. providing means for automatically adjusting a position of the windshield when a gear shift lever of a vehicle is moved away from a neutral position to a position other than neutral, and vice versa.

36. A method, comprising the steps of:

a. providing a helmet for use with a motorcycle;

b. providing a windshield coupled to the helmet; and c. providing means for automatically adjusting a position of the windshield when a gear shift lever of a vehicle is shifted from a second gear position to a third gear position, and vice versa.

37. A method of automatically adjusting a position of a helmet windshield for use with a motorcycle, the method comprising the steps of:

a. sensing sound generated by the motorcycle's engine; and b. performing a Boolean operation to activate a raiser motor for adjusting the position of the helmet windshield in response to the Boolean operation.

38. An apparatus, comprising:

a. a helmet;

b. a windshield coupled to the helmet; and c. means for automatically adjusting a position of the windshield when precipitation detected by a sensor coupled to the helmet crosses a predetermined threshold value.

39. The apparatus of claim 38 wherein the precipitation is at least one of rain, sleet, hail, and snow.

40. The apparatus of claim 38 wherein the sensor is a precipitation sensor.

41. An apparatus, comprising:

a. a helmet;

b. a windshield coupled to the helmet; and c. means for automatically adjusting a position of the windshield when high velocity winds detected by a sensor coupled to the helmet exceed a predetermined threshold value.

42. The apparatus of claim 41 wherein the sensor is a high velocity wind sensor.

43. The apparatus of claim 41 wherein the high velocity winds are sand storms.

44. The apparatus of claim 41 wherein the high velocity winds are gravel storms.

45. A mechanism for a helmet windshield of a motorcycle, comprising means for automatically adjusting a position of the windshield when precipitation detected by a sensor coupled to a helmet crosses a predetermined threshold value.

46. The mechanism of claim 45 wherein the precipitation is at least one of rain, sleet, hail, and snow.

47. The mechanism of claim 45 wherein the sensor is a precipitation sensor.

48. A mechanism for a helmet windshield of a motorcycle, comprising means for automatically adjusting a position of the windshield when high velocity winds detected by a sensor coupled to a helmet exceed a predetermined threshold value.

49. The mechanism of claim 48 wherein the sensor is a high velocity wind sensor.

50. The mechanism of claim 48 wherein the high velocity winds are sand storms.

51. The mechanism of claim 48 wherein the high velocity winds are gravel storms.

52. A method, comprising the steps of:

a. providing a helmet for use with a motorcycle;

b. providing a windshield coupled to the helmet; and c. providing means for automatically adjusting a position of the windshield when precipitation detected by a sensor coupled to the helmet crosses a predetermined threshold value.

53. The method of claim 52 wherein the precipitation is at least one of rain, sleet, hail, and snow.

54. The method of claim 52 wherein the sensor is a precipitation sensor.

55. A method, comprising the steps of:

a. providing a helmet for use with a motorcycle;

b. providing a windshield coupled to the helmet; and c. providing means for automatically adjusting a position of the windshield when high velocity winds detected by a sensor coupled to the helmet exceed a predetermined threshold value.

56. The method of claim 55 wherein the sensor is a high velocity wind sensor.

57. The method of claim 55 wherein the high velocity winds are sand storms.

58. The method of claim 55 wherein the high velocity winds are gravel storms.

59. An apparatus, comprising:

a. a helmet;

b. a windshield coupled to the helmet; and c. means for automatically adjusting a position of the windshield when vehicle speed as indicated by an accelerometer coupled to the vehicle exceeds a predetermined threshold value.

60. The apparatus of claim 59 wherein the accelerometer generates an output signal based on the vehicle speed and electrically communicates with an antenna and filter circuit.

61. The apparatus of claim 59 wherein the means for automatically adjusting comprises a control circuit for performing a Boolean operation.

62. The apparatus of claim 61 further including a power supply coupled to the control circuit for supplying power to the means for automatically adjusting.

63. The apparatus of claim 59 further including a manual override switch coupled to the helmet so that a user can manually adjust the windshield to a desired position.

64. An apparatus, comprising:

a. a helmet;

b. a windshield coupled to the helmet;

c. means for automatically adjusting a position of the windshield, wherein a heat sensor coupled to the helmet activates the windshield to open when ambient temperature exceeds a first predetermined threshold value.

65. The apparatus of claim 64 wherein the heat sensor activates the windshield to close when the ambient temperature drops below a second predetermined threshold value, after a specific time delay period.

66. The apparatus of claim 65 wherein the specific time delay period is a function of the ambient temperature.

67. The apparatus of claim 64 wherein the means for automatically adjusting comprises a control circuit for performing a Boolean operation.

68. The apparatus of claim 67 further including a power supply coupled to the control circuit for supplying power to the means for automatically adjusting.

69. The apparatus of claim 64 further including a manual override switch coupled to the helmet so that a user can manually adjust the windshield to a desired position.

70. A mechanism for a helmet windshield of a motorcycle, comprising means for automatically adjusting a position of the windshield when vehicle speed as indicated by an accelerometer coupled to the motorcycle exceeds a predetermined threshold value.

71. A mechanism for a helmet windshield of a motorcycle, comprising means for automatically adjusting a position of the windshield wherein a heat sensor coupled to a helmet activates the windshield to open when ambient temperature exceeds a first predetermined threshold value.

72. The mechanism of claim 71 wherein the heat sensor activates the windshield to close when the ambient temperature drops below a second predetermined threshold value, after a specific time delay period.

73. The mechanism of claim 72 wherein the specific time delay period is a function of the ambient temperature.

74. A method, comprising the steps of:

a. providing a helmet for use with a motorcycle;

b. providing a windshield coupled to the helmet;

c. providing means for automatically adjusting a position of the windshield when vehicle speed as indicated by an accelerometer coupled to the motorcycle exceeds a predetermined threshold value.

75. The method of claim 74 wherein the accelerometer generates an output signal based on the vehicle speed and electrically communicates with an antenna and filter circuit.

76. A method, comprising the steps of:

a. providing a helmet for use with a motorcycle;

b. providing a windshield coupled to the helmet;

c. providing means for automatically adjusting a position of the windshield, wherein a heat sensor coupled to the helmet activates the windshield to open when ambient temperature exceeds a first predetermined threshold value.

77. The method of claim 76 wherein the heat sensor activates the windshield to close when the ambient temperature drops below a second predetermined threshold value, after a specific time delay period.

78. The method of claim 77 wherein the specific time delay period is a function of the ambient temperature.

* * * * *